US005533455A

United States Patent [19]

Theurer et al.

[11] Patent Number: 5,533,455

[45] Date of Patent: Jul. 9, 1996

[54] TAMPING TOOL ASSEMBLY

[75] Inventors: Josef Theurer, Vienna; Friedrich Peitl, Linz, both of Austria

[73] Assignee: Franz Plasser Bahnbaumaschinen-Industriegessellschaft m.b.H, Vienna, Austria

[21] Appl. No.: 501,853

[22] Filed: Jul. 13, 1995

[30] Foreign Application Priority Data

Aug. 9, 1994 [AT] Austria ..... 1550/94

[51] Int. Cl.[6] ..... E01B 27/02

[52] U.S. Cl. ..... 104/12

[58] Field of Search ..... 104/10, 12

[56] References Cited

U.S. PATENT DOCUMENTS

| | | | |
|---|---|---|---|
| 3,465,688 | 9/1969 | Theurer | 104/12 |
| 4,773,333 | 9/1988 | Theurer | 104/12 |
| 5,133,263 | 7/1992 | Theurer | 104/12 |

FOREIGN PATENT DOCUMENTS

| | | |
|---|---|---|
| 384447 | 4/1987 | Austria . |
| 314933 | 5/1989 | European Pat. Off. . |
| 569836 | 11/1975 | Switzerland . |

*Primary Examiner*—S. Joseph Morano
*Attorney, Agent, or Firm*—Collard & Roe

[57] ABSTRACT

A tamping tool assembly comprises two pairs of tamping tools succeeding each other in the direction of elongation of a railroad track, two of the tamping tools of the pairs being adjacent each other and the other two tamping tools of the pairs being remote from each other. It includes a first vertically adjustable tamping tool carrier, a first crank shaft mounted on this tamping tool carrier, drives connecting the two adjacent tamping tools and one of the remote tamping tools to the first crank shaft for reciprocating the two adjacent tamping tools and the one remote tamping tool, a first drive for vertically adjusting the first tamping tool carrier for immersing the two adjacent tamping tools in the ballast between the two successive ties and the one remote tamping tool in the ballast adjacent one of the ties, a second vertically adjustable tamping tool carrier, a second crank shaft mounted on this tamping tool carrier, a drive connecting the other remote tamping tool to the second crank shaft for reciprocating the other remote tamping tool, a vertical guide whereon the second tamping tool carrier is mounted, and a second drive for vertically adjusting the second tamping tool carrier independently of the first tamping tool carrier for immersing the other tamping tool in the ballast adjacent the other one of the successive ties.

6 Claims, 1 Drawing Sheet

TAMPING TOOL ASSEMBLY

BACKGROUND OF THE INVENTION

1. Field of the Invention

The present invention relates to a tamping tool assembly for tamping ballast underneath two successive ties of a railroad track, which comprises two pairs of tamping tools succeeding each other in the direction of elongation of the railroad track, two of the tamping tools of the pairs being adjacent each other and the other two tamping tools of the pairs being remote from each other, vertically adjustable tamping tool carrier means, crank shaft means mounted on the tamping tool carrier means, drive means connecting the tamping tools to the crank shaft means for reciprocating the tamping tools in the direction of elongation of the railroad track, a drive for vertically adjusting the tamping tool carrier means for immersing the tamping tools in the ballast, and an independent drive for vertically adjusting one of the remote tamping tools for immersion in the ballast independently of the other tamping tools.

2. Description of the Prior Art

Such a ballast tamping tool assembly for simultaneously tamping ballast underneath two successive ties has been disclosed in Austrian patent No. 384,447. In this tamping tool assembly, a central crank shaft for vibrating the tamping tools is mounted on a vertically adjustable tamping tool carrier, and drives connect the two adjacent and the two remote tamping tools of two pairs of tamping tools to the central crank shaft. A parallelogram linkage connects each remote tamping tool to the tamping tool carrier for vertically adjusting each remote tamping tool in a vertical plane extending parallel to the direction of elongation of the railroad track independently of the vertical adjustment of the common tamping tool carrier.

U.S. Pat. No. 4,773,333 also describes a tamping tool assembly with a central crank shaft for vibrating the tamping tools which is mounted on a vertically adjustable tamping tool carrier, and drives connect the two adjacent and the two remote tamping tools of two pairs of tamping tools to the central crank shaft. The remote tamping tools have tamping picks which may be independently vertically adjusted.

In the ballast tamping tool assembly of published European patent application No. 314,933, four independently vertically adjustable tamping tools are arranged in succession for selectively immersing two or four tools in the ballast for tamping either a single tie or two successive ties.

U.S. Pat. No. 5,133,263 and Swiss patent No. 569,836 disclose tamping heads for simultaneously tamping three successive ties. The tamping tool assembly comprises two adjacently arranged, vertically adjustable tamping tool carriers each carrying three tamping tools, two of the tamping tools forming a central pair of tamping tools and being mounted on a respective one of the tamping tool carriers. The central one of the three successive ties can be tamped only when both tamping tool carriers are vertically adjusted to immerse the two tamping tools in the ballast adjacent the central tie.

SUMMARY OF THE INVENTION

It is the primary object of this invention to provide a ballast tamping tool assembly of the first-described type, in which an independently vertically adjustable remote tamping tool of two successive pairs of tamping tools has an improved capability of sustaining stress.

This and other objects are accomplished according to the invention in a tamping tool assembly for tamping ballast underneath two successive ties of a railroad track, which comprises two pairs of tamping tools succeeding each other in the direction of elongation of the railroad track, two of the tamping tools of the pairs being adjacent each other and the other two tamping tools of the pairs being remote from each other, by providing a first vertically adjustable tamping tool carrier, a first crank shaft mounted on the first tamping tool carrier, drive means connecting the two adjacent tamping tools and one of the remote tamping tools to the first crank shaft for reciprocating the two adjacent tamping tools and the one remote tamping tool in the direction of elongation of the railroad track, a first drive for vertically adjusting the first tamping tool carrier for immersing the two adjacent tamping tools in the ballast between the two successive ties and the one remote tamping tool in the ballast adjacent one of the ties, as well as a second vertically adjustable tamping tool carrier having an end face facing an end face of the first tamping tool carrier, a second crank shaft mounted on the second tamping tool carrier, drive means connecting the other remote tamping tool to the second crank shaft for reciprocating the other remote tamping tool in the direction of elongation of the railroad track, a vertical guide whereon the second tamping tool carrier is mounted for vertical adjustment, and a second drive for vertically adjusting the second tamping tool carrier independently of the first tamping tool carrier for immersing the other tamping tool in the ballast adjacent the other one of the successive ties.

In such a tamping tool assembly, the independently vertically adjustable remote tamping tool becomes essentially an independent tamping head, and there is no vertical adjustment mechanism between this tamping tool and its carrier or between the tamping tool and its pick which impairs the ability of the tamping pick to sustain the considerable stress to which it is subjected during tamping. In this way and without in any way decreasing the required mechanical stability of the tamping tools and particularly their ability of being immersed rapidly in the ballast, it is possible to convert the assembly substantially without delay from tamping one tie or two successive ties, simply by selectively actuating the vertical adjustment of the two tamping tool carriers. Since the independently vertically adjustable tamping tool has the required stability, the weakening of the adjustment mechanisms of the prior art due to the constant vibrations to which they are subjected is no longer present.

BRIEF DESCRIPTION OF THE DRAWING

The above and other objects, advantages and features of the present invention will become more apparent from the following detailed description of a now preferred embodiment thereof, taken in conjunction with the accompanying, somewhat schematic drawing wherein.

DETAILED DESCRIPTION OF THE PREFERRED EMBODIMENT

Figure 1:
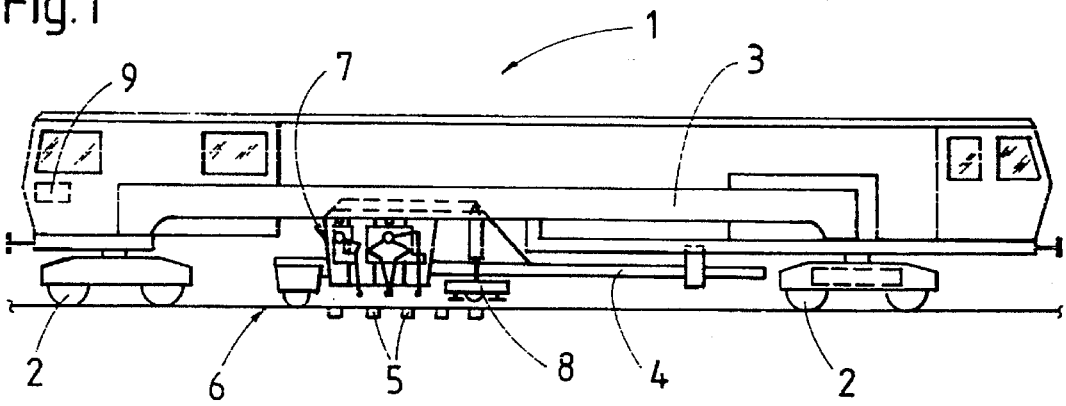
FIG. 1 is a simplified side elevational view of a continuous tamper for tamping ballast simultaneously underneath two successive ties during each tamping stage as the tamper advances continuously along a railroad track.

Referring first to FIG. 1, tamper 1 advances continuously along track 6 comprising successive ties 5 during a tamping operation. The tamper comprises elongated machine frame 3 supported by undercarriages 2 on track 6, and satellite frame 4 displaceable relative to machine frame 3 in the direction of elongation of the machine frame and the track. The satellite frame supports tamping tool assembly 7 for simultaneously tamping ballast underneath two successive ties 5 and track lifting and lining assembly 8. Central control 9 on the tamper is arranged to actuate the operating drives. Tampers of this type are well known.

Figure 2:
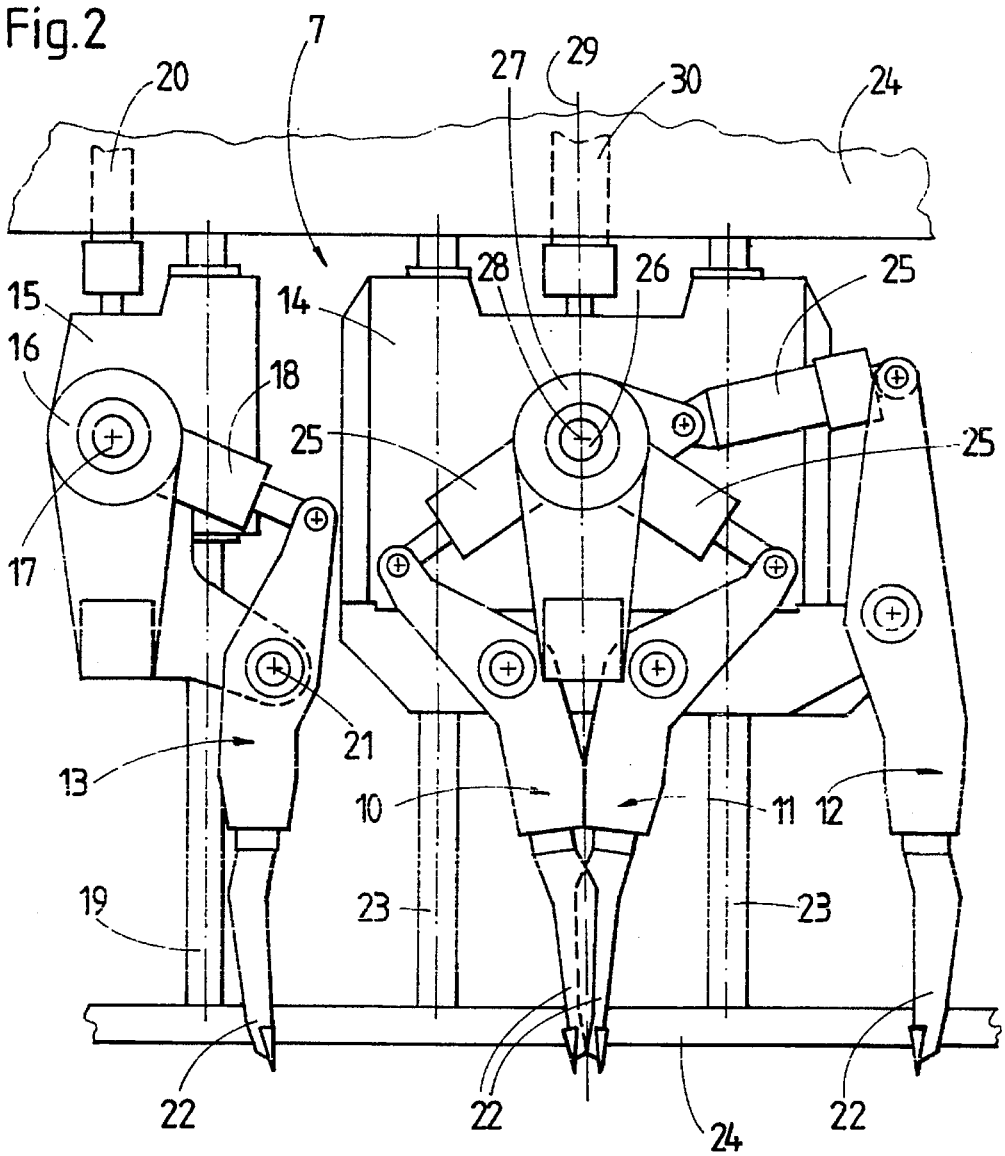
FIG. 2 is an enlarged side elevational view of the tamping tool assembly of this invention.

As shown in FIG. 2, tamping tool assembly 7 for tamping ballast underneath two successive ties 5 of railroad track 6 comprises two pairs of tamping tools 11, 12 and 10, 13 succeeding each other in the direction of elongation of railroad track 6. Two tamping tools 10, 11 of the pairs are closely adjacent each other for immersion in a crib between two successive ties and the other two tamping tools 12, 13 of the pairs are remote from each other. Two such pairs of tamping tools are arranged on the gage and field sides of each track rail, as is also well known in tamping tool assemblies of this general type.

As shown, tamping tool assembly 7 comprises first vertically adjustable tamping tool carrier 14, first crank shaft 26 of a tamping tool vibration drive 27 mounted on first tamping tool carrier 14, and drives 25 connecting the two adjacent tamping tools 10, 11 and one of the remote tamping tools 12 to first crank shaft 26 for reciprocating the two adjacent tamping tools 10, 11 and the one remote tamping tool 12 in the direction of elongation of the railroad track 6. First drive 30 is arranged for vertically adjusting first tamping tool carrier 14 for immersing the two adjacent tamping tools 10, 11 in the ballast between two successive ties and the one remote tamping tool 12 in the ballast adjacent one of the ties. Furthermore, the tamping tool assembly comprises second vertically adjustable tamping tool carrier 15 having an end face facing an end face of first tamping tool carrier 14, second crank shaft 17 of vibration drive 16 mounted on second tamping tool carrier 15, and drive 18 connecting the other remote tamping tool 13 to second crank shaft 17 for reciprocating the other remote tamping tool 13 in the direction of elongation of the railroad track 6. The second tamping tool carrier 15 is displaceably mounted for vertical adjustment on vertical guide 19, which has a polygonal, for example, rectangular, cross section, and second drive 20 is arranged for vertically adjusting second tamping tool carrier 15 independently of first tamping tool carrier 14 for immersing the other tamping tool 13 in the ballast adjacent the other one of the successive ties.

Other tamping tool 13 is mounted on second tamping tool carrier 15 for pivoting about horizontal axis 21 extending perpendicularly to the direction of elongation, and the other tamping tools 10, 11, 12 are similarly mounted on first tamping tool carrier 14. Also, each tamping tool carries tamping pick 22 at a lower end thereof.

Preferably and as shown in the drawing, second crank shaft 17 is arranged remote from the end face of second tamping tool carrier 15, and vertical guide 19 is arranged between the other remote tamping tool 13 and the second crank shaft. Furthermore, as shown, a common carrier frame 24 may be provided for tamping tool carriers 14 and 15, vertical guide 19 for second tamping tool carrier 15 and vertical guides 23 for first tamping tool carrier 14 mounting the tamping tool carriers on the common carrier frame. This common carrier frame is mounted on satellite frame 4 shown in FIG. 1.

Also, as shown in the illustrated preferred embodiment, adjacent tamping tools 10, 11 and reciprocating drives 25 thereof are arranged symmetrically with respect to vertical plane of symmetry 29 passing through axis of rotation 28 of first crank shaft 26.

Control 9 enables first and second drives 20, 30 for vertically adjusting first and second tamping tool carriers 14, 15 to be commonly actuated for moving together.

If the two tamping tool carriers are synchronously moved by control 9, all the tamping picks 22 are immersed together in the ballast for simultaneously tamping two successive ties 5 during each tamping stage, after which they are raised together while tamper 1 advances to the next tamping stage. If and when an obstacle is encountered along the track, which prevents tamping pick 22 of the other remote tamping tool 13 to be immersed in the ballast, only vertical adjustment drive 30 is actuated by control 9 so that only tamping tools 10, 11 and 12 are immersed in the ballast.

It is advantageous for the operation of tamper 1 if independently vertically adjustable tamping tool 13 precedes the other tamping tools in the operating direction of the tamper.

What is claimed is:

1. A tamping tool assembly for tamping ballast underneath no more than two successive ties of a railroad track, which essentially consists of (a) two pairs of tamping tools succeeding each other in the direction of elongation of the railroad track, two proximal tamping tools of the pairs being adjacent each other and two distal tamping tools of the pairs being remote from each other and arranged at respective ends of the assembly in said direction, (b) a first vertically adjustable tamping tool carrier, (c) a first crank shaft mounted on the first tamping tool carrier, (d) drive means connecting the two adjacent proximal tamping tools and one of the distal tamping tools to the first crank shaft for reciprocating the two adjacent proximal tamping tools and the one distal tamping tool in the direction of elongation of the railroad track, (e) a first drive for vertically adjusting the first tamping tool carrier for immersing the two adjacent proximal tamping tools in the ballast between the two successive ties and the one distal tamping tool in the ballast adjacent one of the ties, (f) a second vertically adjustable tamping tool carrier having an end face facing an end face of the first tamping tool carrier, (g) a second crank shaft mounted on the second tamping tool carrier, (h) drive means connecting the other distal tamping tool to the second crank shaft for reciprocating the other distal tamping tool in the direction of elongation of the railroad track, (i) a vertical guide whereon the second tamping tool carrier is mounted for vertical adjustment, and (j) a second drive for vertically adjusting the second tamping tool carrier independently of the first tamping tool carrier for immersing the other distal tamping tool in the ballast adjacent the other one of the successive ties.

2. The tamping tool assembly of claim 1, wherein the second crank shaft is arranged remote from the end face of the second tamping tool carrier.

3. The tamping tool assembly of claim 2, wherein the vertical guide is arranged between the other distal tamping tool and the second crank shaft.

4. The tamping tool assembly of claim 1, further comprising a common carrier frame for the tamping tool carriers, the vertical guide for the second tamping tool carrier and vertical guide means for the first tamping tool carrier mounting the tamping tool carriers on the common carrier frame.

5. The tamping tool assembly of claim 1, wherein the adjacent proximal tamping tools and the reciprocating drive means thereof are arranged symmetrically with respect to a vertical plane of symmetry passing through the axis of rotation of the first crank shaft.

6. The tamping tool assembly of claim 1, further comprising a control for commonly actuating the first and second drives for vertically adjusting the first and second tamping tool carriers together.

* * * * *